US005681181A

United States Patent [19]

Atsumi

[11] Patent Number: 5,681,181

[45] Date of Patent: Oct. 28, 1997

[54] INSULATION DISPLACEMENT CONNECTOR

[75] Inventor: Keigo Atsumi, Yokkaichi, Japan

[73] Assignee: Sumitomo Wiring Systems, Ltd., Japan

[21] Appl. No.: 527,258

[22] Filed: Sep. 12, 1995

[30] Foreign Application Priority Data

Dec. 26, 1994 [JP] Japan ..... 6-338071

[51] Int. Cl.[6] ..... H01R 4/24

[52] U.S. Cl. ..... 439/404

[58] Field of Search ..... 439/395–404

[56] References Cited

U.S. PATENT DOCUMENTS 4,693,536 9/1987 Colleran et al. ..... 439/404

5,120,235 6/1992 Kashiwa ..... 439/399

FOREIGN PATENT DOCUMENTS 3121664 12/1991 Japan .

*Primary Examiner*—J. J. Swann

*Attorney, Agent, or Firm*—Jordan B. Bierman; Bierman, Muserlian and Lucas LLP

[57] ABSTRACT

An insulation displacement connector prevents a sheathed cable from being readily moved by an external force after the sheathed cable is temporarily inserted in a cable insertion gap. A plurality of guide projections (13) stand on a connector housing (11) of the insulation displacement connector at a given distance in two rows. A cable insertion gap (15) is defined between the adjacent guide projections (13) for receiving a sheathed cable (14). The guide projection (13) is provided on each of the opposite sides of the top end with a shoulder (22) extending toward the gaps (15) to prevent the sheathed cable (14) from coming out of the gaps (15). The guide projection is provided on each of the opposite sides defining the gaps (15) with a holding ridge (21) having a triangular cross section and extending from the underside of the shoulder (22) to the proximal end. The holding ridges (21) on the opposite sides of the guide projection (13) compress an insulation sheath of the sheathed cable (14) to prevent the sheathed cable from coming out of the gaps (15).

2 Claims, 7 Drawing Sheets

INSULATION DISPLACEMENT CONNECTOR

BACKGROUND OF THE INVENTION (1) Field of the Invention

This invention relates to an insulation displacement connector in which a guide structure for a sheathed cable is improved.

(2) Statement of the Prior Art

For convenience of explanation, an example of a conventional insulation displacement connector will be described below by referring to FIG. 12. FIG. 12 is a perspective view of the conventional insulation displacement connector.

As shown in FIG. 12, a conventional insulation displacement connector comprises a connector housing 1, a plurality of guide projections 2 which stand on the connector housing 1 at a given distance to define cable insertion gaps 3, and an insulation displacement terminal 4 mounted on the connector housing 1. When a sheathed cable 5 is pressed into the cable insertion gaps 3, the sheathed cable 5 is pressed into contact edges of the insulation displacement terminal 4 while the cable 5 is being guided by the gaps 3. Then, the contact edges grip a sheath of the sheathed cable 5 so that the contact edges make contact with core conductors in the cable 5.

In the insertion displacement connector, since a number of sheathed cables 5 are pressed into the insulation displacement terminal 4 at the same time, the cables 5 are subject to a substantial pressing resistance. Thus, a press machine is used upon a cable insertion work. In this case, all cables 5 are temporarily inserted in the cable insertion gaps and then the temporary assembly is set on the press machine to carry out the cable insertion work.

However, the sheathed cables 5 inserted in the gaps 3 are readily moved longitudinally by an external force since a structure in which the sheathed cables 5 are temporarily inserted in the cable insertion gaps 3 cannot generate a sufficient force to hold the cables 5. When a short sheathed cable 5 is moved in the gaps 3, the cable 5 comes out of the connector housing 1. When a long sheathed cable 5 is moved in the gaps 3, a connecting portion of the cable is displaced from a predetermined position. This results in the troublesome task of correcting the displacement of the cable upon the cable insertion work.

SUMMARY OF THE INVENTION

An object of the present invention is to provide an insulation displacement connector which can effectively prevent a sheathed cable from being moved after being temporarily inserted into cable insertion gaps.

In order to achieve the above object, an insertion displacement connector of the present invention in which a plurality of guide projections stand on a connector housing at a given distance to define a plurality of cable insertion gaps, and the connector housing is provided with an insulation displacement terminal adapted to grip an insulation sheath of a sheathed cable being inserted into the cable insertion gaps so that the terminal makes contact with core conductors in the sheathed cable, is characterized in that each of the guide projections is provided on each of the opposite sides defining the gaps with a holding ridge adapted to compress the insulation sheath of the sheathed cable.

Each of the guide projections may be provided on each of the opposite sides of the top end with a shoulder extending toward the gap to prevent the sheathed cable from coming out of the gaps. Each of the guide projections may be provided with a vertical slit extending from the top end thereof to the proximal end for permitting the projection to below elastically deformed. Once connected, a sheathed cable is once inserted into the cable insertion gaps between the guide projections and then pressed into the insulation displacement terminal to grip the insulation sheath of the sheathed cable. Since the guide projection is provided on each of the opposite sides defining the gaps with the holding ridge, the holding ridge compresses the insulation sheath of the sheathed cable with the sheathed cable being inserted in the cable insertion gaps.

In particular, since the guide projection is provided on each of the opposite sides of the top end with the shoulder extending toward the gap to prevent the cable from coming out of the gaps, the sheathed cable is constrained from moving in a vertical direction as well as in a longitudinal direction.

A slit formed longitudinally in the guide projection elastically spreads the cable insertion gap upon insertion of the sheathed cable, thereby causing the holding ridge to grip the insulation sheath more strongly.

As described above, according to the insulation displacement connector, it is possible to prevent the sheathed cable temporarily inserted in the gaps from moving longitudinally thereby enhancing production efficiency when a cable is inserted, since the holding ridges on the guide projections grip the insulation sheath of the sheathed cable temporarily inserted in the cable insertion gaps to hold the cable in the gaps. It is also possible to enhance the holding force of the cable.

DETAILED DESCRIPTION OF THE PREFERRED EMBODIMENTS

<First Embodiment>

A first embodiment of the present invention will be described below by referring to FIGS. 1 to 4.

Figure 1:
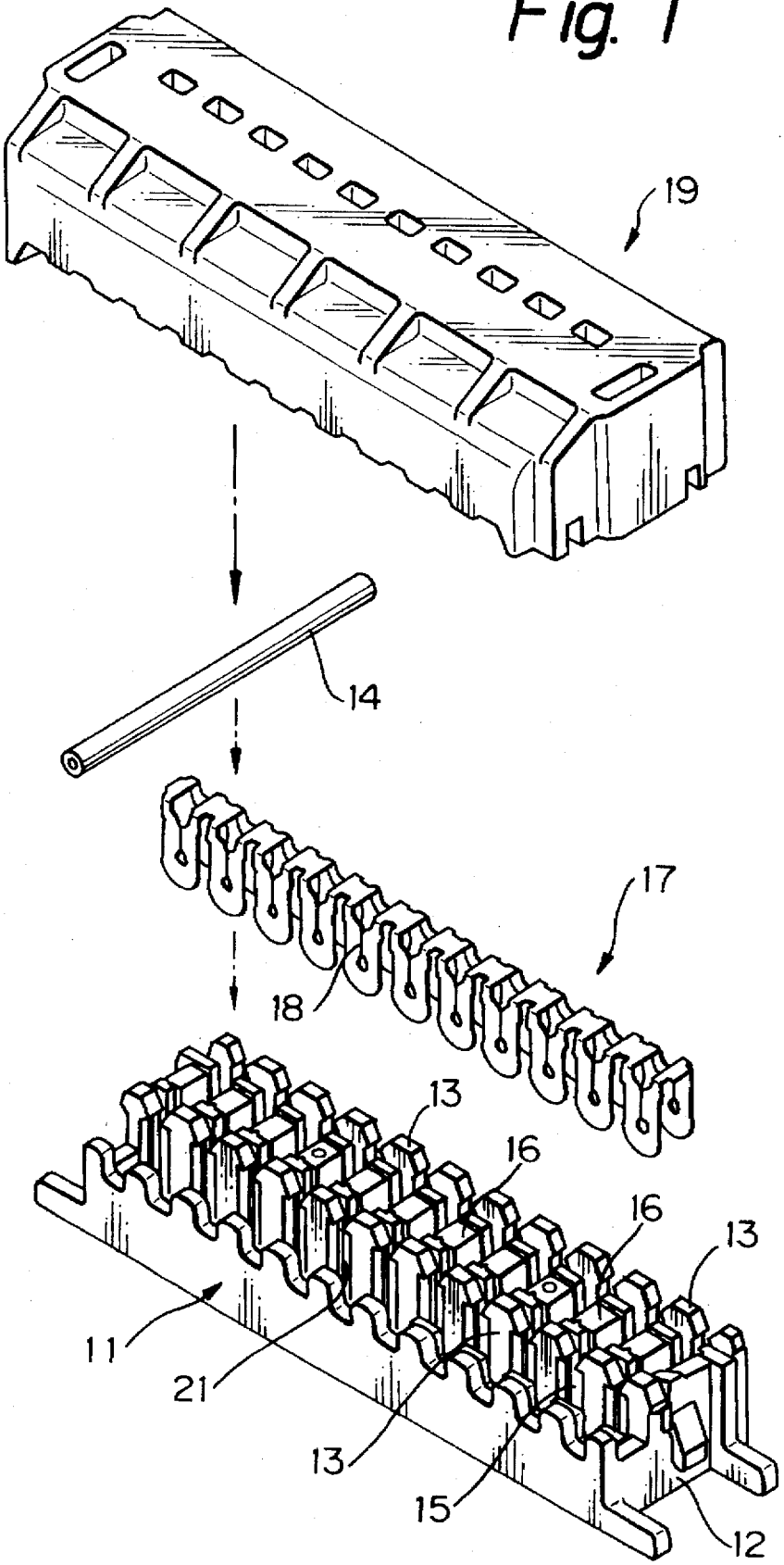
FIG. 1 is an exploded perspective view of an embodiment of an insulation displacement connector of the present invention.

FIG. 1 shows a general structure of an insulation displacement connector of the present invention. A connector housing 11 made of a plastic resin material is provided on a base 12 with a number of guide projections 13 in two rows. Each guide projection 13 is disposed on the base 12 by a distance corresponding to an outer diameter of a sheathed cable 14 to define a cable insertion gap 15 between the adjacent guide projections 13 for receiving the sheathed cable 14.

Terminal holding projections 16 are disposed on the base 12 between the rows of the guide projections 13. An insulation displacement terminal 17 is mounted on the terminal holding projections 16. The terminal 17 has connection gaps 18 corresponding to the respective cable insertion gaps in the connector housing 11. When the sheathed cable 14 is pressed in the connector gaps 18, the insulation displacement terminal 17 breaks an insulation sheath 14*a* (FIG. 2) of the sheathed cable 14 to make electrical contact with core conductors 14*b*.

On the other hand, a cover 19 is formed into a box-like body which is open at the bottom. The cover 19 is provided on its upper interior with a plurality of press ridges (not shown) corresponding to the respective connection gaps 18 in the terminal 17. When the cover 19 is mounted on the connector housing 11 the sheathed cables 14 are pushed down by the press ridges in the cover 19, thereby pressing the sheathed cables 14 in the connection gaps 18 in the terminal 17.

Figure 2:
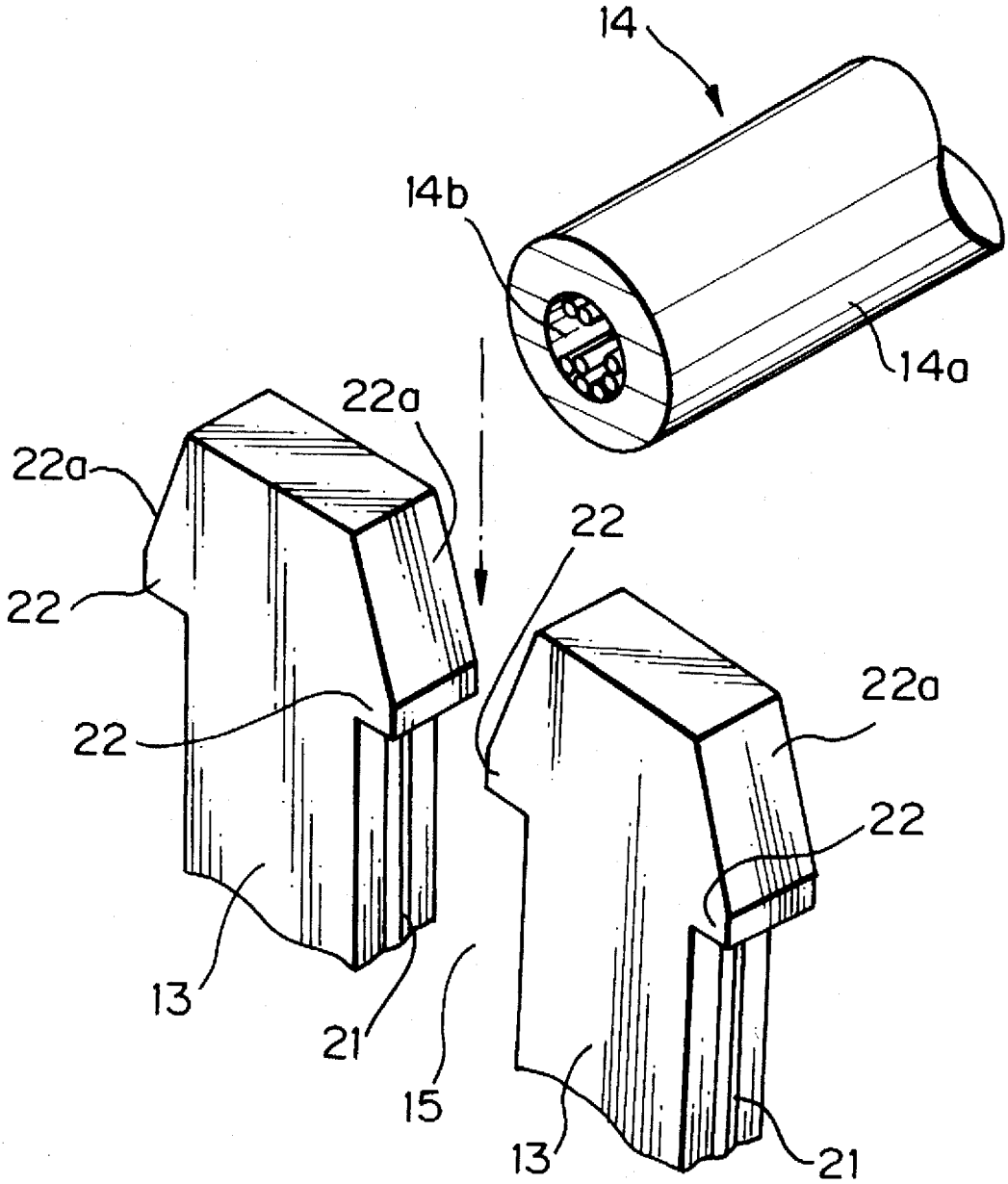
FIG. 2 is an enlarged perspective view of guide projections of the insulation displacement connector shown in FIG. 1.
Figure 3:
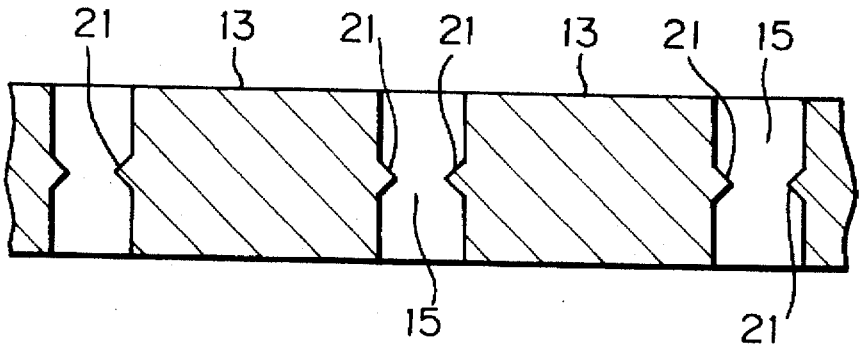
FIG. 3 is a cross sectional view of the guide projections of the insulation displacement connector shown in FIG. 1.

As shown in FIG. 2, the guide projection 13 is provided on each of the opposite sides of the top end (the upper end in FIG. 2) with a shoulder 22 extending toward the insertion gap 15 so that the guide projection 15 is formed into a T-shape. The shoulder 22 is provided on each of its upper portions with a slant face 22*a* extending down to the cable insertion gap 15. The distance between the shoulders 22 is set to be slightly narrower than an outer diameter of the sheathed cable 14. The guide projection 13 is provided on each of its opposite sides facing the cable insertion gaps 15 with a holding ridge 21 which extends from the underside of the shoulder 22 to the proximal end and has a triangular shape in cross section.

Next, an operation of this embodiment will be described below.

In order to connect a group of the sheathed cables 14 to the insulation displacement connector, a single sheathed cable 14 is inserted into the cable insertion gaps 15 in the connector housing 11. During insertion of the cable, when the sheathed cable 14 makes contact with the slant faces 22*a* on the shoulders 22, the distance between the adjacent guide projections is elastically increased, thereby permitting the sheathed cable 14 to enter the cable insertion gaps 15.

Figure 4:
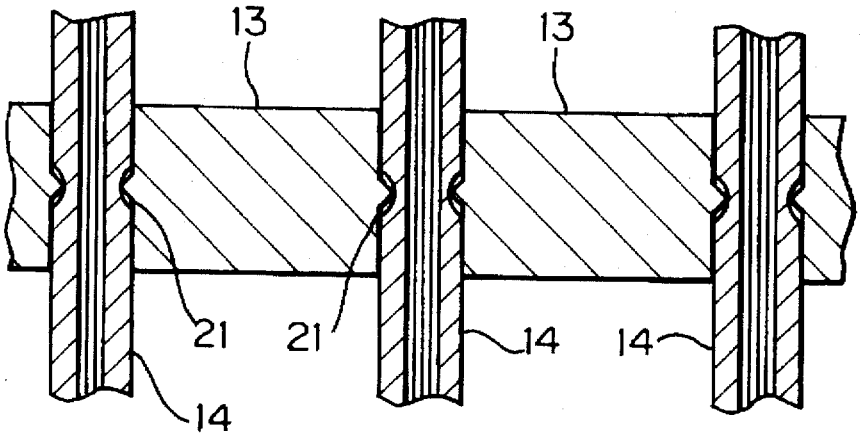
FIG. 4 is a similar view to FIG. 3, but illustrating sheathed cables inserted in insertion gaps between the guide projections of the insulation displacement connector.

When the sheathed cable 14 enters the cable insertion gaps 15, the holding ridges 21 gently grip the insulation sheath 14*a* of the sheathed cable 14, as shown in FIG. 4, so that the sheathed cable 14 is prevented from moving longitudinally. Then, the next sheathed cable 14 is inserted into another cable insertion gap 15. After all of the sheathed cables 14 are inserted in the gaps 15, the cover 19 is mounted on the connector, the connector with the cover 19 is set on the press machine not shown, and the cover 19 is pushed down by the press machine. Then, the press ridges on the cover 19 push down each sheathed cable 14 in the gaps 15, thereby pressing the sheathed cables 14 into the connector gaps 18 in the insulation displacement terminal 17. Thus, insertion of the respective cables is finished.

According to the present embodiment, it is possible to surely prevent the sheathed cables 14 from moving longitudinally even if a worker touches the sheathed cable 14 inserted in the gaps 15 when the next cable 14 is inserted into the gaps 15 after one cable 14 has been inserted in the gaps 15, since the holding ridges 21 grip the sheathed cables 14 to prevent the cables 14 from moving longitudinally when the sheathed cables 14 is inserted into the gaps 15. Accordingly, it is possible to carry out the task of inserting the next sheathed cable 14 without worrying about any movement of the cables 14 which have already been inserted in the gaps 15; it is also possible to carry out the job efficiently, to eliminate having to correct the displaced cables, and eventually to improve production efficiency. Further, since each guide projection 13 is provided on its top end with the shoulders 22, it is possible to prevent the sheathed cables 14 from coming out of the gaps 15 even if the inserted cables 14 are pulled upwardly during insertion of the next cable 14.

<Other Embodiments>

The present invention should not be limited to the above embodiment. For example, the following embodiments may also be carried out.

Figure 5:
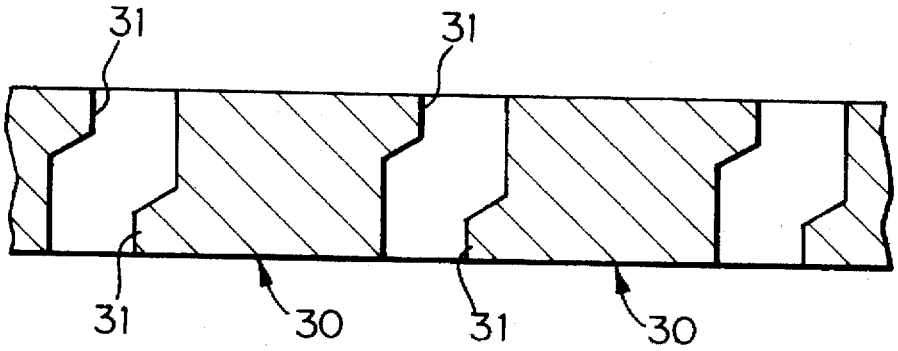
FIG. 5 is a cross sectional view of guide projections in another embodiment of the present invention.
Figure 6:
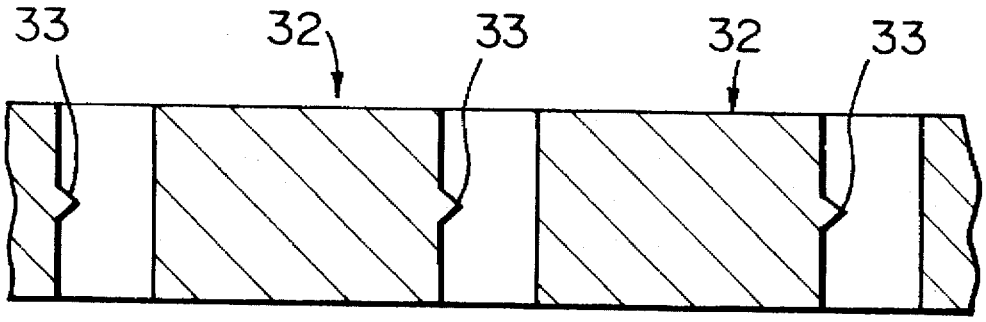
FIG. 6 is a cross sectional view of guide projections in still another embodiment of the present invention.
Figure 7:
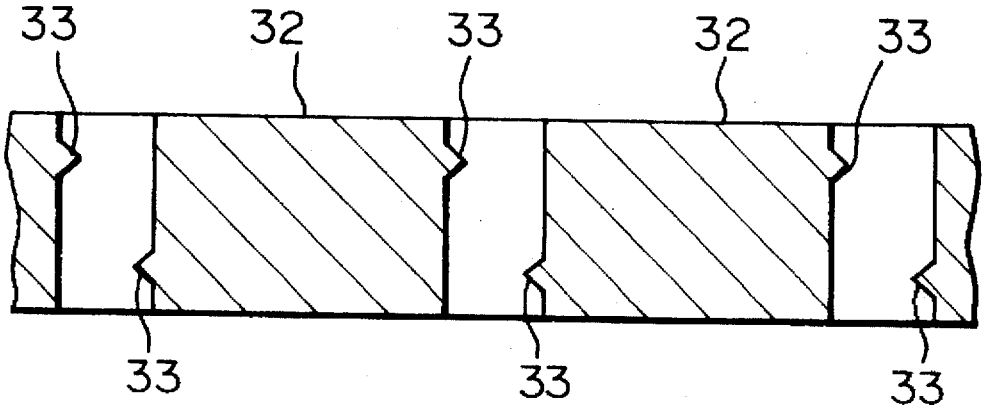
FIG. 7 is a cross sectional view of guide projections in still another embodiment of the present invention.
Figure 8:
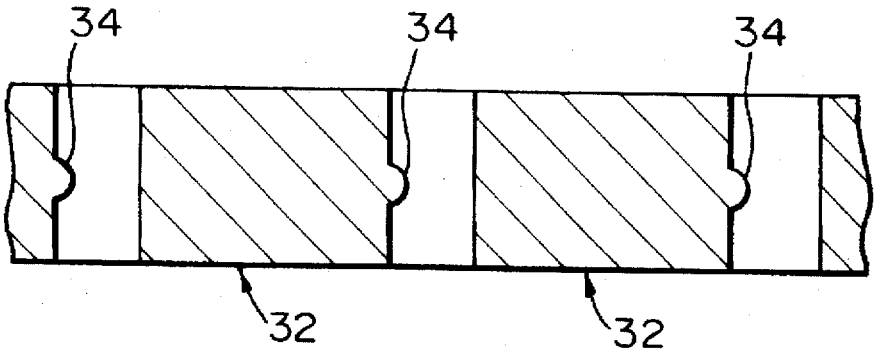
FIG. 8 is a cross sectional view of guide projections in still another embodiment of the present invention.
Figure 9:
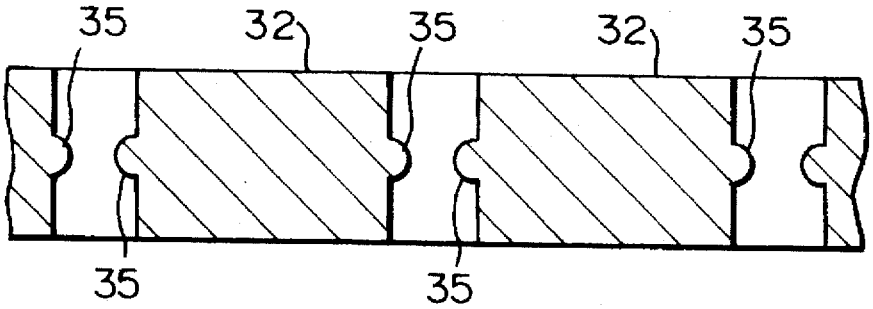
FIG. 9 is a cross sectional view of guide projections in still another embodiment of the present invention.
Figure 10:
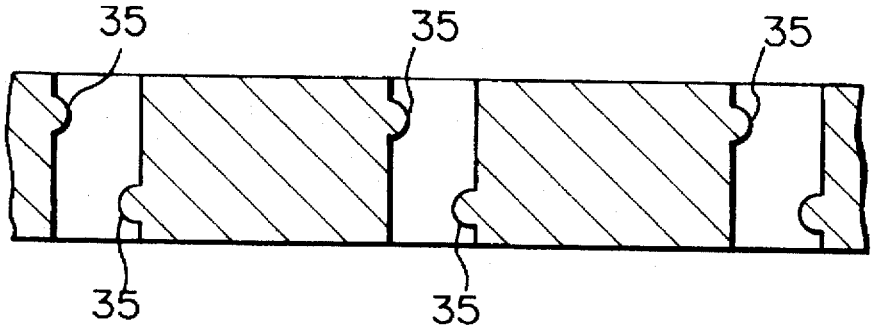
FIG. 10 is a cross sectional view of guide projections in still another embodiment of the present invention.

(1) A shape of the holding ridges on the guide projection is not limited to the above embodiment. For example, as shown in FIG. 5, a pair of holding ridges 31 may be alternately provided on the guide projections 30. Also, as shown in FIG. 6, a holding ridge 33 may be provided on one of the sides of the guide projection 32, or as shown in FIG. 7, holding ridges 33 may be alternately provided on both sides of the guide projection 32. Alternatively, as shown in FIG. 8, a holding ridge 34 having a semi-circular shape in cross section may be provided on one of the sides of the guide projection 32, as shown in FIG. 9, holding ridges 35 having a semi-circular shape in cross section may be provided in opposition to each other on both sides of the guide projection 32, or the holding ridges 35 may be alternately provided on both sides of the guide projection 32 as shown in FIG. 10.

Figure 11:
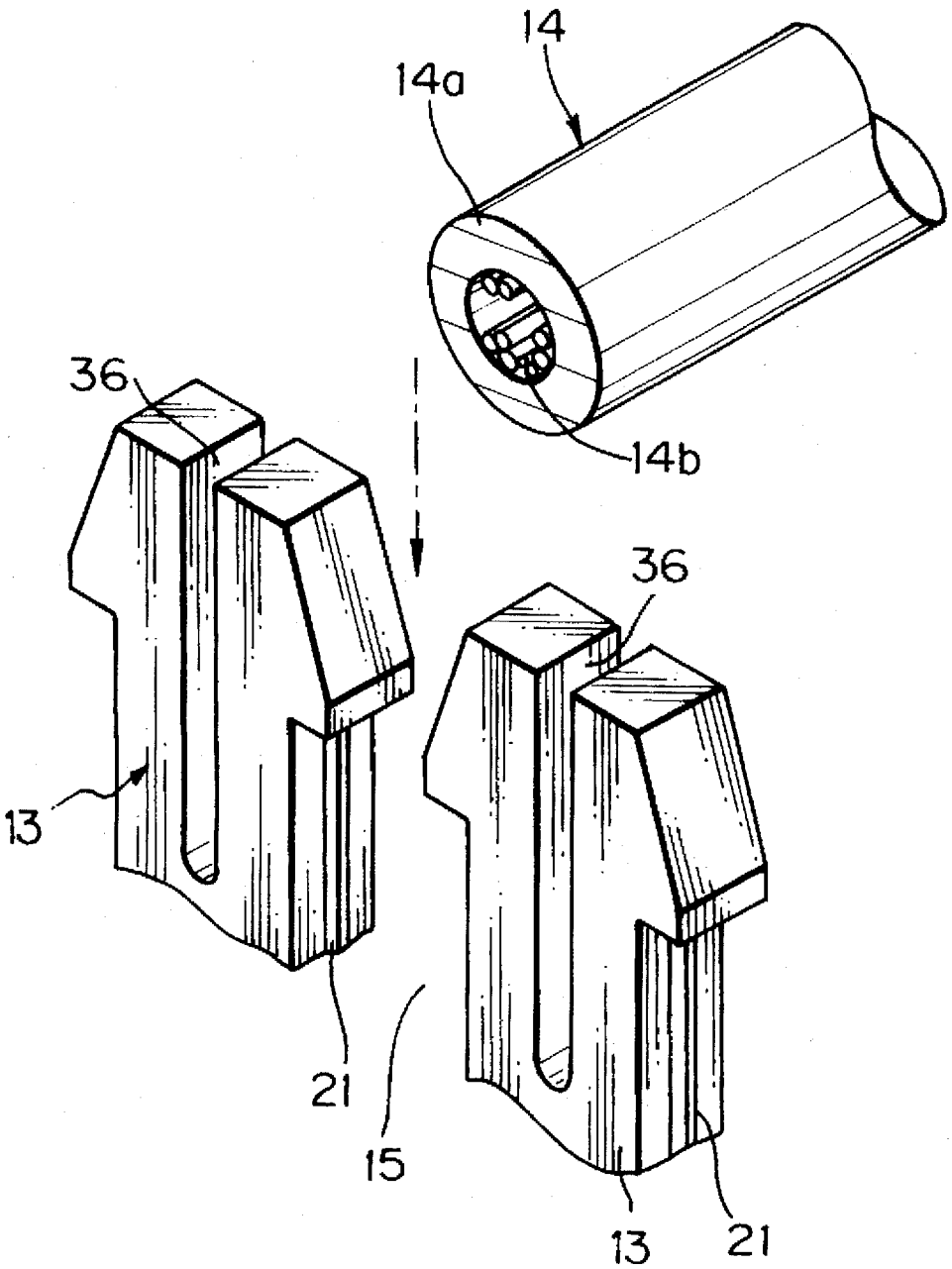
FIG. 11 is a cross sectional view of guide projections in still another embodiment of the present invention.
Figure 12:
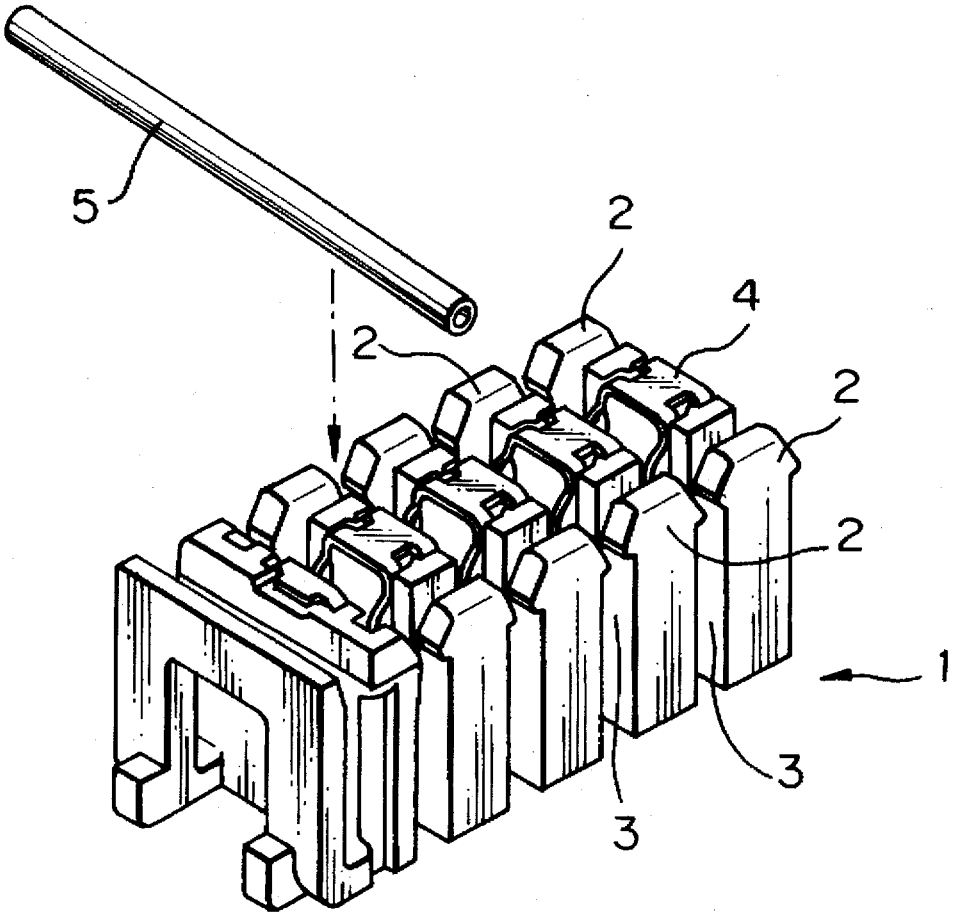
Fig. 12 PRIOR ART
FIG. 12 is a perspective view of a conventional insulation displacement connector.

(2) As shown in FIG. 11, the guide projection 13 may be provided with a vertical slit 36 extending from the top end to the proximal end to cause the projection 13 to be elastically deformed. The slit 36 makes it easy to insert the cable 14 into the cable insertion gaps 15 and enhances a holding force of the cable.

What is claimed is:

1. An insulation displacement connector comprising a plurality of spaced apart guide projections on a connector housing, said housing having an insulation displacement terminal adapted to grip insulation sheaths of sheathed cables being inserted into insertion gaps between said guide projections whereby said terminal makes contact with core conductors in said sheathed cable, each of said guide projections having a holding ridge on at least one of opposite sides which define said insertion gap, said ridge extending in a direction of insertion of said sheathed cable, said ridge adapted to compress said insulation sheath, whereby said sheathed cable is prevented from axial movement at any point within said insertion gap, each of said guide projections constituting a pair of bifurcated projections formed by a vertical slit extending from a proximal end of each of said projections to a free end thereof.

2. An insulation displacement connector according to claim 1, wherein each of said guide projections is provided on opposite sides of said free end with a shoulder extending toward said insertion gap for preventing said sheathed cable from coming out of said gaps.

* * * * *